United States Patent [19]

Duke

[11] 3,951,787

[45] Apr. 20, 1976

[54] METHOD AND APPARATUS FOR SEPARATING GOLD AND OTHER HEAVY MATERIALS FROM ORE

[75] Inventor: Arthur W. Duke, Smyrna, Ga.

[73] Assignee: Great American Silver Company

[22] Filed: Feb. 25, 1974

[21] Appl. No.: 445,545

[52] U.S. Cl. ..... 209/458; 209/244; 209/488; 209/498; 209/506

[51] Int. Cl. ..... B03b 3/00; B03b 11/00

[58] Field of Search ..... 209/498, 499, 500, 501, 209/506, 488, 458, 486, 18, 244, 380, 157

[56] References Cited

UNITED STATES PATENTS

| | | | |
|---|---|---|---|
| 183,319 | 10/1876 | Mills | 209/458 |
| 372,741 | 11/1887 | Card | 209/486 |
| 754,657 | 3/1904 | Bud et al. | 209/458 |
| 847,519 | 3/1907 | Sloane | 209/458 |
| 912,766 | 2/1909 | Wood | 209/458 |
| 1,299,181 | 4/1919 | Harry | 209/458 |
| 1,811,408 | 6/1931 | Stebbins | 209/157 |
| 2,080,977 | 5/1937 | Albrecht | 209/458 |
| 2,171,674 | 9/1939 | Schifferle | 209/157 |
| 2,294,587 | 9/1942 | Vissac | 209/458 |
| 3,033,371 | 5/1962 | Hobart, Sr. | 209/458 |
| 3,269,538 | 8/1966 | Stephan | 209/506 |

*Primary Examiner*—Tim R. Miles
*Assistant Examiner*—Gregory N. Clements
*Attorney, Agent, or Firm*—Newton, Hopkins & Ormsby

[57] ABSTRACT

Apparatus and method for separating heavy materials from ore, the apparatus having a hopper or sluice box open at its top and defining a discharge opening on one side. Spaced, parallel pipes extend across the hopper adjacent, but above, the bottom of the sluice box, the pipes having holes which direct the water sidewise toward the adjacent pipes. The holes of adjacent pipes are staggered with respect to each other. Shields or spreaders, disposed over the top portions of the pipes, protect the pipes from the ore which is charged into the open hopper, these spreaders directing the ore between the sprays of water to produce a slurry which passes out of the side discharge opening over a riffle or extractor, providing a downwardly inclined series of spaced parallel, transversely extending, upright barriers which snare and retain the heavy materials, such as gold and black sand. A plurality of these sluice boxes and ripples are juxtaposed on the flat bed of a truck. A common pump supplies water to the sluice boxes. The process carried out by the apparatus is also described.

19 Claims, 7 Drawing Figures

METHOD AND APPARATUS FOR SEPARATING GOLD AND OTHER HEAVY MATERIALS FROM ORE

BACKGROUND OF THE INVENTION

1. Field of the Invention

This invention relates to hydrometallurgy and is more particularly concerned with an apparatus and method for the recovery of heavy materials from ore. Specifically, the invention is concerned with a sluice and the method in which the sluice operates to recover gold and black sand.

2. Description of the Prior Art

In the past sluices have been used for the gravity separation of gold from sand and gravel. A typical prior art sluice has a hopper or sluice box into which the ore is charged and a flume for directing a stream of water by gravity over the charge, for eroding away the charge, thereby creating a slurry which thence, passed over the inclined gravity separator or extractor, i.e., a "Hungarian Riffle" (a series of upright ribs). The heavy matter is thus retained by the ribs of the riffle as the less dense sand, gravel, silt and water pass off of the riffle.

The prior art sluice operates at a very low rate in that it gradually erodes away the upper increments of the ore deposited in the sluice box. In some instances channels are formed in the ore which further reduce the efficiency of the sluice box.

The present invention provides for the more rapid and efficient generation of a slurry in the sluice box and the more efficient separation of the heavy constituents from the ore.

BRIEF DESCRIPTION OF THE INVENTION

Briefly described, the present invention includes an open sluice box or hopper having, adjacent but above its bottom, a plurality of spaced, parallel, fluid discharge conduits or pipes. The pipes diverge from the bottom as they approach the discharge opening at one side of the sluice box. Each of the pipes is provided with two rows of diametrically opposed holes, each hole of which is chamferred or tapered, inwardly. The holes of one pipe are staggered with respect to the opposing holes of an adjacent pipe. Removable spreaders or shields of selected width cover the pipes and provide spaced supports for the ore. A removable central partition reduces channelling.

The downwardly inclined, gravity separator, extractor or riffle is attached by its upper end to and is supported by a protruding end portion of the bottom. The extractor has spaced, parallel, transversely extending, upstanding ribs, each rib including a pair of converging flanges forming an angle iron. The ends of the spaced parallel angle irons are joined by longitudinal struts to provide a removable riffle frame carried on the flat bottom plate of the riffle pan. Valves and pressure gages permit controlled amounts of water to be fed from a source of water under pressure through a feed header to the pipes. A plurality of sluice units are carried on a flat bed of a truck.

The process, which is performed when the apparatus of the present invention is used, includes charging the ore into the sluice box where the downward movement of the ore is arrested, the ore being initially mechanically separated by the spreaders into large increments. These large increments are then directed, through the water curtains produced by water discharging from the adjacent pipes. The staggered counterflow of the water imparts swirling motions, in opposite directions, to subdivide the large increments into longitudinally spaced adjacent small increments of the charge, eroding these small increments, quite rapidly. This creates a turbulent slurry which is directed out of the discharge opening to cascade down the riffle, leaving the relatively heavy constituents entrapped by the ribs.

The advantages of the present invention include the following:

The apparatus is inexpensive to build, durable in construction and will withstand constant use. A plurality of sluice boxes and extractors are readily and easily transported by truck to remote areas for operation at the mining site. The device is then quickly and easily placed in operation without removing the same from the truck. The sluice box presents a low profile so that it may be charged with ore by conventional earth moving equipment. The incline angle of the sluice box and the incline of the extractor may be, respectively, readily and easily adjusted. The apparatus is, therefore, adaptable to varying terrain. The apparatus is quite simple to operate and, once the angles are adjusted and water is flowing, operates automatically and does not usually require readjustment of the water feed.

About the only problems which will be encountered in using the device are that the pipes may become clogged and the hopper may collect large rocks. The pipes, however, are readily flushed, when desired, and the spreaders and pipes are removable so that the rocks can be removed.

The invention should recover in excess of 90% of the gold in quartz sand. Six or more units can be carried on a single truck bed and all six can be operated by a single operator.

One of the major advantages of the present invention is the high volume of placer ore which can be processed. For example, an average sluice unit can process about 400 pounds of quartz sand per minute. Thus, if ore is supplied to the sluice boxes, one operator should be able to process in excess of 1 ton of ore, per minute, with the equipment which is carried by a single truck.

DETAILED DESCRIPTION

Gold has a specific gravity of 19.3 while black sand has a specific gravity of about 5.0. On the other hand, silt has a specific gravity of about 1 and quartz sand, about 2.5. It is, therefore, seen that, in a water slurry, gold will settle out of quartz sand, quite readily. Also, since black sand is heavy, it too will settle out. The sluice unit 100, hereinafter described, will, quite rapidly, produce a water slurry with the quartz sand ore and its retained gold and/or black sand by directing the water transversely of the spaced longitudinal increments of the bottom of a pile of ore so as to erode or undercut the ore, causing the ore to progressively collapse and permitting the gold particles to drop or gravitate to the bottom panel 10 of the sluice box 8, whence the slurry, while still turbulent, will move it onto the riffle or extractor 50, cascade down the slurry and its entrained heavy material then the riffle or extractor 50 so that the heavy constituents are retained by the riffle or extractor 50.

Figures 1, 2:
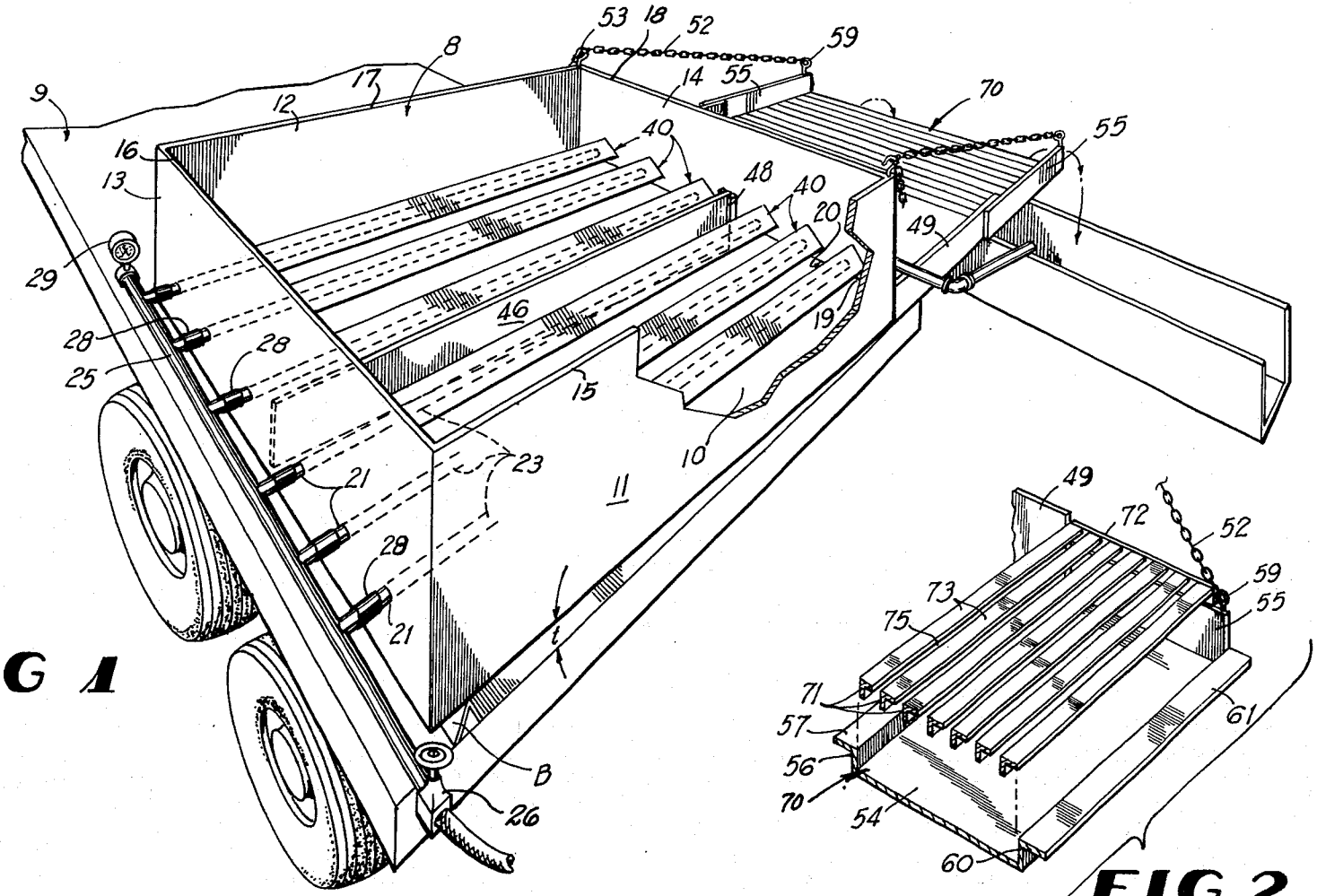
FIG. 1 is a fragmentary perspective view of a sluice unit constructed in accordance with the present invention, and showing its sluice box disposed on the flat bed of a truck, the sluice box supporting the extractor in an operative position.
FIG. 2 is a fragmentary exploded perspective view of the riffle frame and riffle pan of the extractor seen in FIG. 1.

With respect to the apparatus of the present invention, in FIG. 1 it is seen that the sluice box, or hopper, denoted generally by numeral 8 is mounted on the flat bed 9 of a truck. The sluice box 8 has a flat, rectangular, metal base or bottom panel 10 and side panels 11 and 12 which extend upwardly from opposite edges of the bottom panel 10. Side panel 11 and side panel 12 are complimentary, being disposed in parallel, longitudinal planes in opposition to each other. The rearmost edges of the side panels 11 and 12, panel 10 and bottom are joined by a rectangular rear panel 13 while the forward edges of the sides 11 and 12 are joined by a rectangular front panel 14.

The panels 11, 12, 13 and 14 are each flat members respectively provided with upper edges 15, 16, 17 and 18, these upper edges being disposed in a common horizontal plane, parallel to and spaced from the slightly inclined bottom panel 10. The panels 10, 11, 12, 13 and 14 are sheet metal members which form a box defining an open chamber for the receipt, through its open upper end, of ore to be processed. Panels 13 and 14 are disposed in perpendicular relationship to panels 11 and 12 so as to be parallel to each other and extend, transversely. The lower edge 19 of the front panel 14 is spaced above the bottom panel 10 so as to define, with the side panels 11 and 12 and the bottom panel 10 a rectangular front discharge opening 20, through which the slurry is discharged from the sluice box 8.

Any suitable means can be employed for tilting the sluice box 8 sidewise on the flat bed 9. For example, I have employed a wedge or block B which is disposed between the upper surface of the bed 9 and the rear portion of bottom panel 10, as seen in FIG. 1. By moving the wedge B toward or away from the discharge end of sluice box 8, the angle *t* of tilt can be increased or decreased.

Disposed along a horizontal line of centers, parallel to and spaced above the bottom panel 10, are a plurality of equally spaced holes 21 in the rear panel 13. A corresponding series of holes 22 are provided in the front panel 14, these series of holes 22 being along a line of centers adjacent to the bottom edge 19 of panel 14 but spaced above the bottom panel 10 by a distance greater than the distance from bottom panel 10 to the line of centers of the holes 21.

Figure 3:
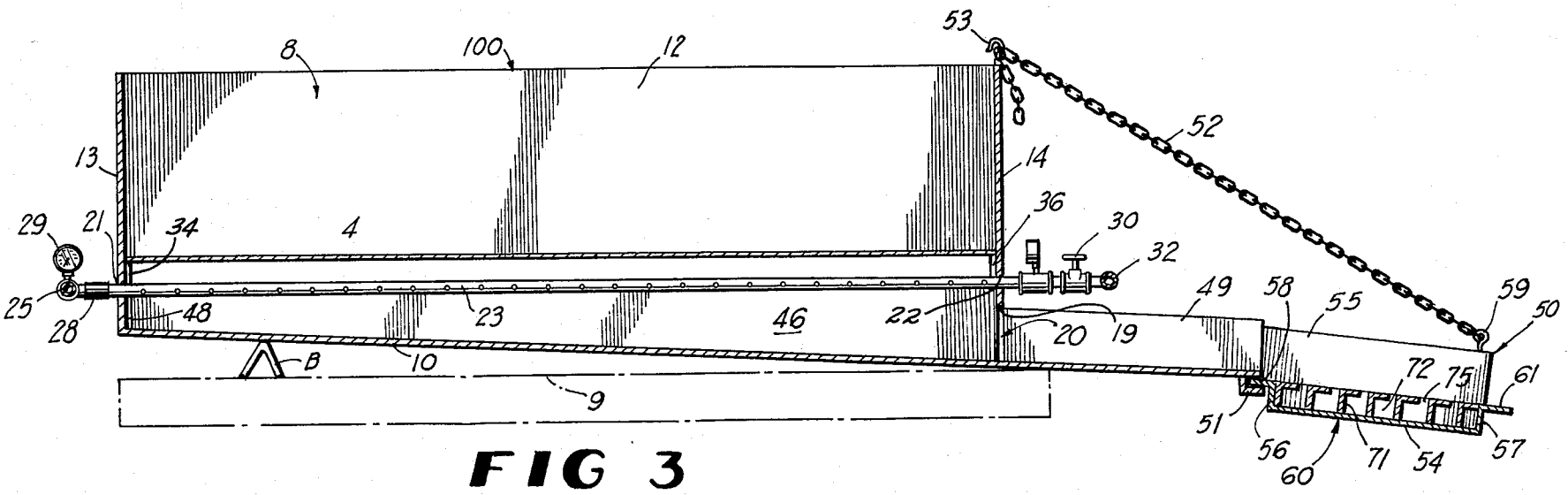
FIG. 3 is a longitudinal vertical sectional view of a portion of the apparatus shown in FIG. 1.

A plurality of rigid, straight, hollow, tubular pipes or conduits 23 are inserted through the holes 21 and thence through the holes 22 so that each pair of holes 21 and 22 removably receives a pipe 23. Since the holes 22 are above the holes 21 with respect to bottom panel 10, the pipes 23, while being disposed parallel to each other, nevertheless diverge progressively from the bottom panel 10 in the direction of the discharge opening 20, as seen in FIG. 3.

Outwardly of rear panel 13, is a transverse water header 25 provided, at one end, with a globe valve 26. As seen best in FIG. 7, the other end of the globe valve 26 connects to a source of water under pressure, via a hose 27, leading from a pump header H.

The pump header H, in turn, is connected to the discharge port of a water pump P. The pump P takes a suction from a lake, river or stream or reservoir R, or other source of water, via its intake conduit C, discharging the water, under pressure, to the pump header H. The pump header H, in addition to being connected to hose 27, is connected to a plurality of additional water supply hoses 227, 327, 427, 527 and 627 which supply water for the simultaneous operation of additional sluice units 200, 300, 400, 500 and 600 which are in juxtaposition with each other and with sluice unit 100 on the flat bed 9 of the truck.

Each additional unit 100, 200, 300, 400, 500 and 600 is identical in construction to the illustrated sluice unit 100 of FIGS. 1 through 6. Thus, suffice it to state that all sluice units 100, 200, 300, 400, 500, and 600 discharge to a common side of the truck bed 9, into a trough T which returns the water and spent ore to the reservoir R.

Returning now to the specific construction of sluice unit 100, the water header 25 has a plurality of flexible hoses 28 which are, respectively, connected to and communicate with the outwardly protruding rear ends of the pipes 23. Therefore, when the globe valve 26 is opened, water is supplied, via the water header 25 and via the flexible hoses 28 to the pipes 23, substantially simultaneously. A pressure gauge 29 is provided for the header 25, preferably at its low pressure end.

Figure 7:
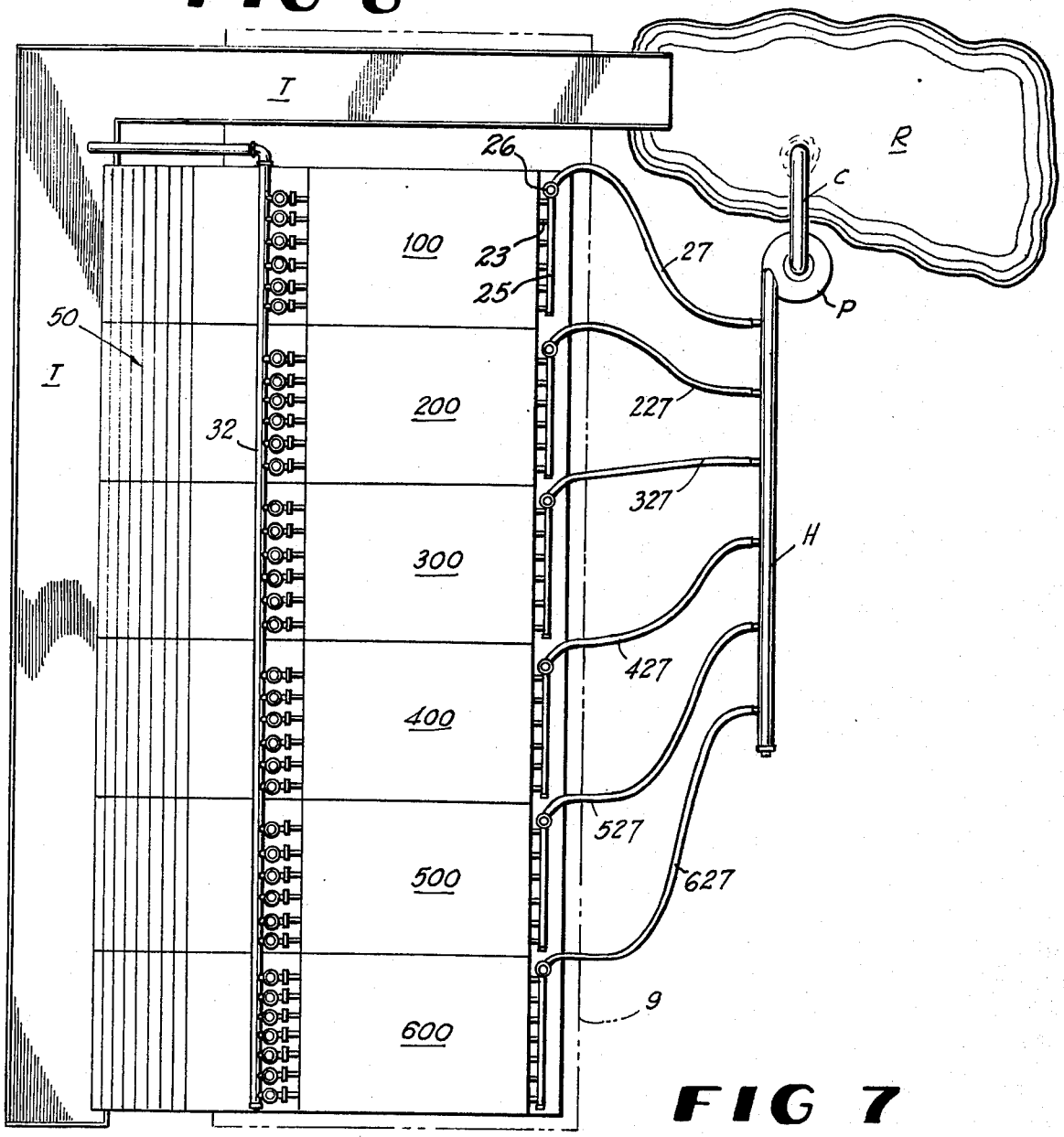
FIG. 7 is a schematic top plan view of a plurality of sluice units on a truck bed operatively connected to a source of water.

The forward ends of the pipes 23, outwardly of panel 14, are respectively provided with individual drain valves 30. Each valve 30 can be cycled to flush out its pipe 23. The discharge ends of valves 30 are connected to a discharge header 32 which, in turn, discharges to trough T. As seen in FIG. 7, the discharge header 32 is common to all sluice units.

Along the inside surface of the rear panel 13, above the holes 21 are brackets which respectively consists of a pair of straight upwardly converging angle brackets 34 (seen in FIG. 3). The angle brackets 34 have arms respectively disposed at 45° to the bottom panel 10 and are disposed perpendicularly, with respect to each other. On the inside surface of front panel 14, above the holes 23 are brackets 36 (seen in FIG. 4) which are complimentary to brackets 34. Opposed pairs of these brackets 34 and 36 respectively removably support, therebetween, an angle iron shield or spreader 40 which includes a pair of right angularly disposed straight flat rectangular flanges 41 and 42 which are joined along a common upper edge 43. These spreaders 40 are removed from the brackets 34 and 36 by lifting them vertically. Thus, shields or spreaders 40 with wider or narrower flanges 41 and 42 can be provided to vary the clearance between adjacent flanges 41 and 42 of adjacent shields or spreaders 40. The shields or spreaders 40 are preferably wider than the pipes 23 so as to extend over and totally protect the pipes 23 from contact with the ore deposited through the open top of the sluice box 8. Spreaders 40 also provide slurry material avenues of escape for increments of ore from beneath ore body.

Figure 6:
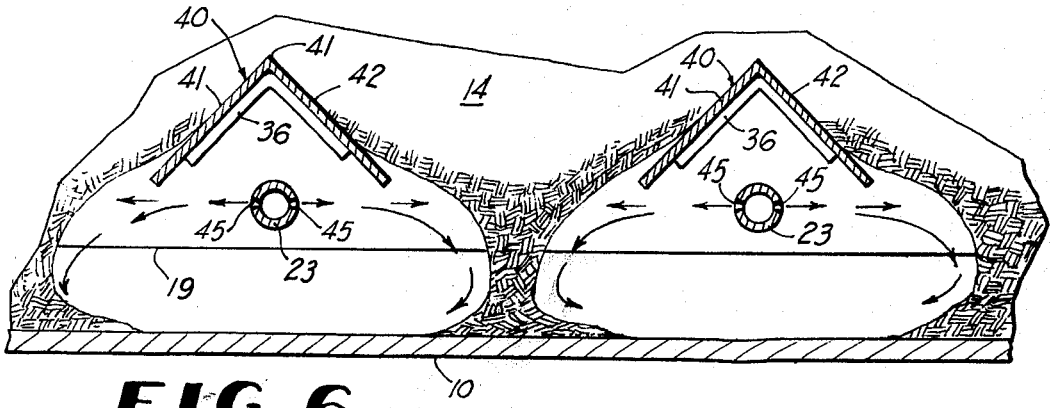
FIG. 6 is an enlarged vertical sectional view of two spreaders and two pipes of the sluice box, the ore being received on the spreaders and being eroded or undercut by the water from the pipes.

Each of the pipes 23 is provided with a plurality of evenly spaced diametrically opposed holes 45, the first series of holes 45 on one side being along an axial line of centers throughout substantially the length of each pipe 23. The second or opposed series of holes 45 is along an axial line of centers in diametrically opposed relationship to the first series of holes 45. Each of these holes 45 is chamferred or tapered inwardly as seen in FIG. 6 to form conical openings which will define a nozzle for the discharge of water laterally, i.e., sidewise from the pipe 23, in fan like diverging fashion.

Figure 5:
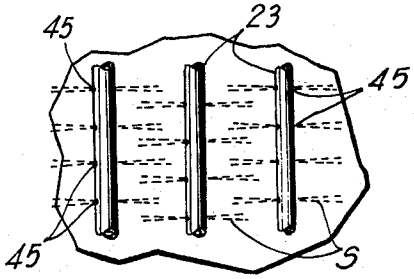
FIG. 5 is a fragmentary plan view of a detail, showing the pipes of the sluice box of the apparatus shown in FIG. 1 creating curtains of water.
Figure 4:
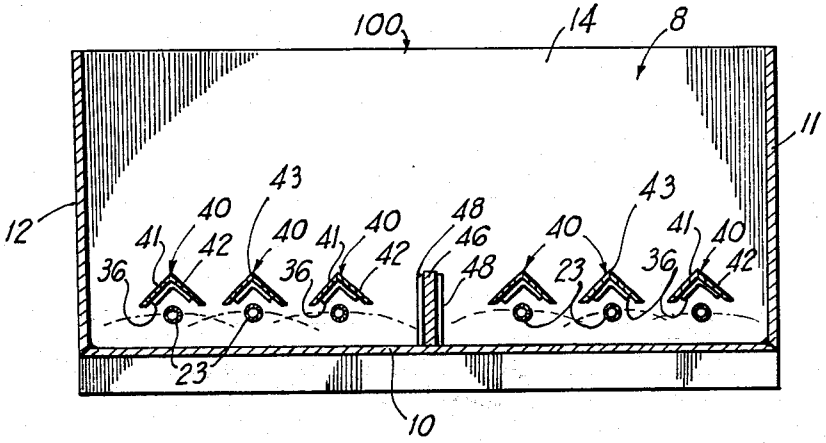
FIG. 4 is a transverse vertical sectional view of the sluice box of the apparatus shown in FIG. 1.

As seen in FIG. 5, the holes 45 of one pipe 23 are staggered with respect to the holes of the adjacent pipe 23 so that the individual streams of water S directed sidewise in one direction into the mixing zone does not interfere with the individual streams S directed from the opposite side of the common mixing zone in the opposite direction, but such streams S cooperate to create a curtain of water in each mixing zone between adjacent pipes 23, through which the stream of ore must fall.

After the progressive increments of ore from each of the streams of ore have respectively been mixed with water, they produce, with the water, a slurry which falls to bottom panel 10. The respective slurries from the mixing zones are then comingled and pass out of box 8.

Longitudinally along the centerline of the sluice box 8, equidistant between the side panels 11 and 12 is a removable partition 46. The partition 46 is preferably a flat, generally rectangular, plate resting on bottom panel 10, the partition 46 being parallel to side panels 11 and 12. One end of the partition 46 is sandwiched by spaced, parallel, upstanding, guides 47 mounted on the inside surface of panel 11. The other end of partition 46 is received by similar guides 48 on the inside surface of panel 14. As seen in FIG. 1, the upper edge of partition 46 is slightly higher than the upper edges 43 of the spreader 40.

The function of the partition 46 is to break up the chamber, below the spaced parallel mixing zones, into a pair of complimentary, slurry receiving, compartments which receive approximately equal amounts of the comingled slurry. This reduces the tendency of the water to flow to the outer side panels 11 and 12 and form channels adjacent these outer side panels, as the slurry is fed along parallel adjacent prescribed paths toward the separator 50. By providing the partition, additional vertical surfaces are produced against which the slurry impinges and will rebound to maintain the agitation and the slurry conditions.

As pointed out above, the bottom panel 10 protrudes outwardly beyond the front panel 14, the side edge of this protruding portion of panel 10 being provided with upstanding side flanges 49 so as to form a U-shaped channel to direct the water ore slurry, discharged through the discharge opening 20, along the panel 10. The ends of the upstanding flanges 49 are integrally connected to the leading edges of the side panels 11 and 12.

The rear end of riffle, separator or extractor 50, best seen in FIGS. 2 and 3, is removably secured by its transverse rear edge to bottom panel 10 by a forwardly opening support bracket 51 along the bottom surface of panel 10. The forward end of extractor 50 is retained in place by a pair of chains 52 which are carried by upstanding hooks 53 mounted at the forward upper corners of the sluice box 8. The lower end of the chains 53 are secured to the sides of the extractor 50, as will be explained more fully hereinafter.

The riffle, separator or extractor 50, itself, which provides for the gravity or weight differential separation of the cascading slurry, includes an accumulator pan 60 having a flat, downwardly inclined bed plate 54, opposed, upstanding longitudinal sides 55 and opposed transverse upstanding rear and front walls 56 and 57. The rear wall 56 has an outwardly turned flange 58 which is removably received by bracket 51. The chains 52 are secured, at the lower ends, to eyelets 59 mounted at the distal ends of the sides 55, as seen in FIG. 3. The lower or front wall 57 is provided with a transverse lip 61, over which the water is discharged into trough T.

The pan 60 is, thus, disposed on an incline and removably receives therein the riffle frame, denoted generally by numeral 70. The riffle frame 70 consists of a plurality of spaced parallel upstanding ribs 71 which extend transversely across the flat bed plate 54, their lower edges resting on the plate 54. Parallel struts, such as strut 72, connect the adjacent ends of ribs 71 to provide the rigid, rectangular frame 70. The upper edge portions of each of ribs 71 is provided with a forwardly extending, flat, rectangular ledge 73, each of which projects toward the discharge ends of the extractor 50. The upper surfaces of the ledges 73 are in a common inclined plane with flanges 58 and 61, parallel to plate 54, so as to present a smooth surface to the flowing slurry, such surface being interrupted by successive, transverse, equally spaced, slots 75.

The height of the frame 70 and its dimensions are such that it will just fit into the pan 60 of the extractor 50, one end strut 72 abutting the inside surface of side 55, and the other abutting the inside surface of the other side 55. The distance between sides 55, however, are wider than the distance between flanges 49 so that the end portions of sides 55 overlap an end portion of the flanges 49 when pan 60 is installed.

When the slurry passes out of the sluice box 8, it passes downwardly along ledges 73 and over lip 61, into the trough T. The gold and black sand, being heavy, drops out and is retained by ribs 71. When sufficient gold particles and/or black sand is accumulated, the separator 50 is removed and the frame 70 lifted out of the pan 60. The pan 60 is then dumped onto a vibrating screen separator (not shown) for further gravity separation.

In construction, the flanges 41 and 42 are usually 4 inches or 5 inches in width, to provide a clearance, between adjacent flanges, of about 3⅝ inches with the larger spreader or shield 40 and a clearance, between edges, of about 5 inches when the smaller flange is used.

The water pressure used is from about 5 p.s.i. to about 35 p.s.i. and the holes 45 are usually provided with a 30° taper. Usually from 5 to 10 p.s.i. will provide a water flow of about 12,000 gallons per hour for the six units 100, 200, 300, 400, 500 and 600. This flow of water will process the ton of rock and gravel per minute, mentioned above.

The sluice box 8, i.e. the bottom panel 10 of box 8 is on a tilt of from about 10° to about 15°, from the horizontal, the optimum tilt being 12°. The riffle or separator 50 is inclined at a greater angle of tilt, as a rule. This separator 50 is thus usually angled at from about 15° to about 35° from the horizontal.

The device, described above, is usually capable of recovering gold having a particle size of down to about 8 microns. Thus, a vast majority of gold (above colloidal size) can be extracted, quite rapidly and inexpensively, utilizing the equipment described above. About a 95% recovery, by total weight of the gold in the placer ore is not unusual.

What is claimed is:

1. In the process of recovering heavy material from ore, of the type wherein water and ore is mixed into a slurry which is fed along a prescribed path and the heavy constituents thereof are separated by weight differential from the slurry, the steps, in the formation of the slurry, of:

a. directing the water laterally, relative to the direction of ore movement, in a plurality of spaced individual streams into a plurality of individual mixing zones; and b. passing the unslurried ore from above said mixing zones by gravity downwardly through and past said streams for producing said slurry;

c. collecting the entire slurry below said mixing zones; and d. directing the collected slurry away from and clear of said mixing zones into said prescribed path;

said individual streams being directed in opposite directions toward each other to form a curtain of water in each mixing zone and through which said ore passes;

certain of said individual streams being directed from one side of said mixing zone to the other side thereof and certain other individual streams being directed from said other side towards said one side for engaging opposite side portions of increments of ore passing downwardly therebetween;

said individual streams being spaced from each other, the individual streams from one side being staggered with respect to the individual streams from said other side for imparting swirling motion to the downwardly moving increments of said ore.

2. In an apparatus for the recovery of heavy material from ore:

a. a sluice box having an upright sides and a transverse bottom below said sides for defining an open ore receiving chamber open at its upper end and into which unslurried ore is charged;

b. a plurality of support means carried by said sluice box vertically below the open upper end and spaced above said bottom for supporting a portion of the ore charged into said chamber, said support means being spaced apart from each other to provide a plurality of spaces forming avenues of escape through which increments of the bottom portion of the ore charged into said chamber can fall; and c. conduit means below said support means, said conduit means having spaced holes for directing water against the increments of said ore passing through said avenues for progressively eroding said increments and for progressively forming a slurry with the eroded increments;

d. said sluice box having a discharge opening below said support means and said conduit means for discharging the entire slurry as it is formed;

said support means being parallel members extending longitudinally across said chamber and said discharge opening being transversely of said sluice box and beneath all of said support means.

3. The apparatus defined in claim 2 including channel means communicating with said discharge opening for receiving said slurry and a separator, over which said slurry from said channel means is directed, said separator being removably mounted by one edge portion to said channel means, and means for adjustably supporting the opposite edge portion of said separator and for varying the angle of inclination of said separator.

4. The apparatus defined in claim 2 wherein said conduit means for directing water against the increments of said ore includes a plurality of spaced pipes extending across said sluice box for delivering a plurality of streams of water sidewise therefrom to the lower portion of said sluice box, and said support means are disposed respectively over said pipes for shielding said pipes from the ore being charged into said sluice box.

5. The apparatus defined in claim 4 in which said pipes respectively diverge from said bottom as they approach said discharge opening.

6. The apparatus defined in claim 5 wherein each of said pipes has its holes in diametrically opposed lines and facing holes of adjacent pipes, said facing holes being staggered with respect to each other.

7. The apparatus defined in claim 2 wherein said conduit means for directing water against the increments of said ore includes:

a. a plurality of spaced parallel pipes extending across said sluice box, each of said pipes being spaced above said bottom and provided with spaced holes through which water is directed outwardly from said pipes; and b. said support means includes a plurality of parallel spaced spreaders respectively extending over said pipes, each of said spreaders having downwardly diverging members for directing increments of the ore charged into said sluice box through the spaces between said pipes so that the outwardly directed water engages said increments, said spreaders being sufficiently close to said pipes that they protect said pipes from said ore as the same is charged into said sluice box.

8. The apparatus defined in claim 7 wherein said holes of adjacent pipes are staggered with respect to each other.

9. In a process of recovering the heavy constituents from ore of the type wherein a slurry is formed from the ore and water and the heavy constituents are separated by weight differential from the ore, the steps, in the formation of the slurry, of depositing said ore in an accumulation zone, progressively separating the lowermost portion of said ore into a plurality of spaced increments, progressively passing said spaced increments, as individual streams of ore, respectively downwardly through individual mixing zones, directing water laterally of the passage of the ore under pressure into each of said mixing zones for progressively mixing with said increments to form said slurry, accumulating the slurry including the entire ore beneath said mixing zone and directing the accumulated slurry away from said mixing zones.

10. The process defined in claim 9 wherein said water under pressure is directed from opposite sides of said mixing zone toward the other side thereof.

11. The process defined in claim 9 wherein said water under pressure is directed in a plurality of spaced streams, the streams of water from one side of said mixing zone being staggered with respect to the streams of water from the other side of said mixing zone.

12. The process defined in claim 11 wherein the resulting slurries from said mixing zones are comingled and passed along a prescribed path.

13. The process defined in claim 12 wherein the comingled slurry is passed over a plurality of recesses in said prescribed path, and the heavy constituents are deposited by gravity in said recesses.

14. The process defined in claim 13 wherein said ore is gold ore and said heavy constituents are gold particles.

15. In an apparatus for the recovery of heavy material from ore, said apparatus being of the type having a sluice box provided with a chamber into which the ore and water are charged, said sluice box having a discharge opening adjacent the bottom of the sluice box through which the slurry of ore and water is fed, and including a separator which separates the heavy material from the slurry, the combination therewith of:

means in said sluice box for directing water against the lower portion of said ore for progressively forming with the lower portion, the slurry which is discharged through said discharge opening, said means for directing water against the lower portion of said ore including:

a. a plurality of spaced pipes extending across said sluice box, each of said pipes being spaced above said bottom and provided with holes through which water is directed outwardly from said pipes; and b. a plurality of spaced spreaders respectively extending over said pipes for directing increments of the ore charged into said sluice box through the spaces between said pipes so that the outwardly directed water engages said increments, said spreaders being sufficiently close to said pipes that they protect said pipes from said ore as the same is charged into said sluice box, each of said spreaders including a pair of diverging flanges joined along a common upper edge, said flanges tapering upwardly toward said common edge.

16. The apparatus defined in claim 15 wherein said discharge opening is disposed below and transversely of said pipes.

17. The apparatus defined in claim 16 wherein said discharge opening extends beneath the end portions of all of said pipes.

18. The apparatus defined in claim 15 including a partition along said bottom, parallel to said pipes extending above said pipes.

19. The apparatus defined in claim 15 including a water header transversely of the ends of and communicating with said pipes for supplying water to said pipes.

* * * * *